United States Patent [19]

Vromen et al.

[11] Patent Number: 4,911,181

[45] Date of Patent: Mar. 27, 1990

[54] PLASTIC MOUTHPIECE FOR SIMULATED SMOKING

[75] Inventors: Zwi Vromen, Tel Aviv; Joseph Gross, Moshav Mazor, both of Israel

[73] Assignee: Inventor's Funding Company, Ltd., Tel Aviv, Israel

[21] Appl. No.: 222,534

[22] Filed: Jul. 21, 1988

[30] Foreign Application Priority Data

Sep. 8, 1987 [IL] Israel ..... 83826

[51] Int. Cl.[4] ..... A24F 47/00

[52] U.S. Cl. ..... 131/273; 131/270

[58] Field of Search ..... 128/200.23, 202.21, 128/760, 765; 131/270, 271, 272, 273; 604/133, 135, 142, 146

[56] References Cited

U.S. PATENT DOCUMENTS

| | | | |
|---|---|---|---|
| 2,860,638 | 11/1958 | Bartolomeo . | |
| 3,320,953 | 5/1967 | Rindner . | |
| 3,340,869 | 9/1967 | Bane | 128/765 |
| 3,347,231 | 10/1967 | Chang . | |
| 3,365,102 | 1/1968 | Castleberry . | |
| 3,587,573 | 6/1971 | Flack . | |
| 3,710,804 | 1/1973 | Wey . | |
| 4,083,372 | 4/1978 | Boden . | |
| 4,171,000 | 10/1979 | Uhle . | |
| 4,284,089 | 8/1981 | Ray . | |
| 4,296,071 | 10/1981 | Weiss et al. | 128/765 |
| 4,393,884 | 7/1983 | Jacobs | 131/273 |
| 4,429,703 | 2/1984 | Haber | 131/273 |
| 4,539,985 | 9/1985 | Magrath | 604/133 X |
| 4,569,136 | 2/1986 | Loring | 131/273 |
| 4,655,294 | 4/1987 | Sensabaugh | 131/273 |

FOREIGN PATENT DOCUMENTS

| | | | |
|---|---|---|---|
| 1398033 | 3/1965 | France | 131/270 |
| 2601563 | 1/1988 | France . | |
| 148789 | 5/1965 | Netherlands . | |
| 2089188 | 6/1982 | United Kingdom . | |

*Primary Examiner*—V. Millin
*Assistant Examiner*—D. F. Crosby
*Attorney, Agent, or Firm*—Oblon, Spivak, McClelland, Maier & Neustadt

[57] ABSTRACT

The invention includes a cigarette like device which enables the user to experience the taste and aroma as well as the tactile sensations of smoking a tobacco cigarette—but without the presence of smoke, without any combustion, and without inhalation of harmful carcinogenic substances (e.g. tars) into the user's lungs. The device consists of a plastic mouthpiece containing a plug of chewing tobacco connected to a plastic tube with an axial duct, extending to a sealed end, where there is located a pumping member in the form of a flexible accordion-like, or bellows-type configuration or a spring-loaded ball or position. In a further embodiment, the device consists of a conventional mouthtip filter, or a tubular body with a flexible collapsible side wall sealed at the far end, and a tobacco insert. In the device, repeated suction cycles by the user are utilized to initially draw the user's saliva through the tobacco insert to flavor it with nicotine, and then to recirculate this saliva back to the user's mouth on successive suction cycles, allowing the user to taste and smell the nicotine. Inserts other than tobacco can be used in the device (e.g. menthol, various medications and the like).

11 Claims, 2 Drawing Sheets

PLASTIC MOUTHPIECE FOR SIMULATED SMOKING

BACKGROUND OF THE INVENTION

Field of the Invention

Smokers all over the world are aware of the dangers they stand by continuing to smoke the regular types of cigarettes, cigars or the like.

It has been proven that the major damage to smokers is caused by the tar residues transfered by the inhaled smoke to the lungs, causing tar deposits on the lungs. These deposits are major causes for lung cancer and other incurable damages.

The partial oxidation that occurs during smoking to the paper or other cellulose parts in the cigarettes result in a large proportion of carbon monoxide in the released cigarette smoke. When the smoke is being inhaled these quantities of carbon monoxide enter the bloodstream, thus causing a reduction of available oxygen in the blood, and hence great disturbances to the heart function. It is well known that cigarette smoking is a major reason for several heart diseases.

It has therefore been the aim of many products to attract smokers away from smoking cigarettes, thus reducing the medical risks, yet retaining some of the pleasures caused by the supposed addiction to cigarettes.

It has been proven that most smokers who wish to stop smoking are addicted to several features of the smoking procedure, namely:

the sensation of holding a mouthpiece and sucking it,

The taste of nicotine, the major aroma of tobacco,

The ritual of taking in and blowing out the smoke.

DESCRIPTION OF THE RELATED ART

Many products have been developed successfully for this market answering to one or two of the desired functions of the addicted smokers. Such products incude among others:

Sucking or chewing tobacco, in loose form or as teabags, or plastic chewable capsules.

Chewing gum having tobacco or nicotine taste.

Plastic cigarette holders having aroma sources introduced to their end allowing the user to suck in the aromas when holding the plastic cigarette in the mouth and sucking air through it.

In all these products only partial solutions are given to the desired addicted functions.

Several patents describing such products are known in the prior art:

GB No. 2089188 describes an artificial cigarette having a mouthpiece stimulating the moisture glands in the mouth, containing a flavouring or liquorice which releases the aroma on chewing the mouthpiece. The mouthpiece is interchangeable when the aroma is exhausted.

NL No. 148789 describes a cigarette comprising a mouthpiece filled with tobacco, a coaxial tube emits nicotine—water vapor or other aroma on heating. the cigarette is open on both ends for air to be drawn through.

FR No. 2601563 describes a cigarette comprising a cylindrical body, the user can create a low pressure zone by sucking, thus causing absorption of an atomized liquid stored in a foam cylinder, which is dispensed by a piston activating a spray jet.

All these products have certain disadvantages namely:

GB No. 2089188 is in fact a type of chewing-gum which releases the aroma on chewing, It is in the shape of an artificial cigarette.

NL No. 148789 operates only when heat is applied, so that the cigarette must be lit or heated, thus causing smoke which may disturb the surrounders of the user.

FR No. 2601563 supplies aroma only from a prestored liquid, which is atomized when the cigarette is sucked. Whereas in the invention moist or dry tobacco is used to extract the aroma into the saliva, which was sucked into the device from the user's mouth.

None of these devices can replace the sensation to smokers given by a cigarette, at minimal production cost.

SUMMARY OF THE INVENTION

It is the purpose of this invention to combine the maximum desired functions of the addicted smoker and provide a safe solution to the smoker enabling him with relative ease to cease smoking and slowly adjust himself to a safe mode of tobacco sucking enjoyment leaving him most features of cigarette smoking without the damage.

The invention hereby provides a smokeless cigarette comprising; a mouthpeice and a tube containing a tobacco bed; and pumping means at the end of said tube; so that when suction is applied at the mouthpeice by the user, the pumping means create a vacuum in the cigarette tube; the vacuum draws in saliva from the user's mouth when the suction is ceased; and the saliva passing through the tobacco bed draws nicotine and aroma from the tobacco and transports it to the user's mouth when the suction process is repeated; so that the user has a continuous sensation of nicotine aroma drawn from the cigarette.

Several types of pumping devices have been tried. In one of the prefered embodiments the pumping device is made of a flexible pliable plastic material in the form of a concertine having a sealed end. When suction is caused, the pumping end collapses inward towards the smoker, and when suction ceases, the end is forced to reopen by action of the flexible material. It is made of similar types of concertine structures which are known in drinking straws with flexible ends, or in an accordion, or in children's whistles with concertine endings.

In another preferred embodiment the pump could be made of a cylindrical end piece connected on one end to the axial inner tube, and on the other having a small open hole facing away from the smoker, having a plastic disc or ball introduced into the cylinder with a diameter slightly smaller than the inner diameter of the cylindrical ending. Said disc or ball will act as a piston. The disc or ball will be attached on the inner side to a spring forcing the disc or ball always to return to its original position near the tip of the cylinder end.

When the cigarette user sucks in air, the disc or ball will overcome the spring's action and move towards the mouthpiece, and when suction is released, the spring will push the disc or ball back to its original position, thus pushing the air into the cylinder through the end hole and thereby causing suction from the mouth of the user and causing the exit of saliva from the mouth through the tobacco.

In the most prefered embodiment the pumping element is made of a collapsable flexible tube, attached on one end to a mouthpiece and on the other end sealed by an end piece; the tobacco is placed in the collapsable tube in any required amount; so that when the user applies suction at the mouthpiece, the tube's walls collapse inwards; and when the suction is stopped the tube returns to its original shape, and vacuum is formed in the tube, drawing inwards saliva from the user's mouth; so that when the operation is repeated the saliva entering the tube picks up nicotine and aroma from the tobacco, and returns to the user's mouth with the next suction.

In a preferred version of the invention the mouthpiece has a filter at its tip, allowing free flow of saliva, but holding back flow of tobacco particles from the tube to the mouth.

Brief Description Of The Drawing

The invention can be illustrated by the following drawings, wherein.

Description Of The Preferred Embodiments

Figure 1:
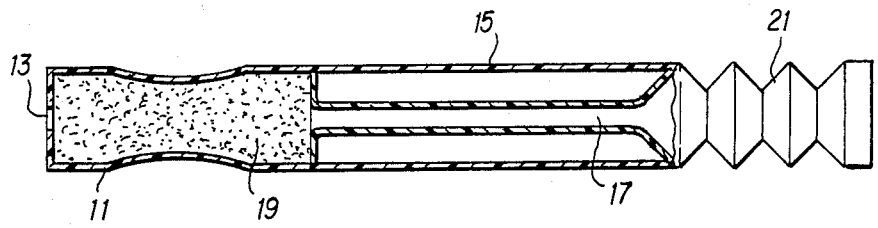
FIG. 1 illustrates a plastic cigarette having a pliable flexible pumping device end.

FIG. 1—The mouthpiece 11 has an entry hole 13 and is connected to an inner tube 17 passing coaxially through the plastic tube 15.

The mouthpiece 11 contains the chewing tobacco 19.

The end pumping piece 21 which forms a chamber is made of a flexible pliable plastic material.

When the user sucks through the hole 13 or the mouthpiece 11, the air is sucked out from the chamber 21, causing the collapse of the chamber 21. When the user stops suction, pumping end chamber 21 reopens due to the flexibility of the plastic material, thus causing suction through the tube 17 and, thus sucking in saliva from the user's mouth through the opening 13 into the tobacco 19. In the next suction cycle by the user, said saliva, saturated with tobacco, will be sucked back into the mouth and introduce nicotine aroma into the mouth of the user.

Figure 2:
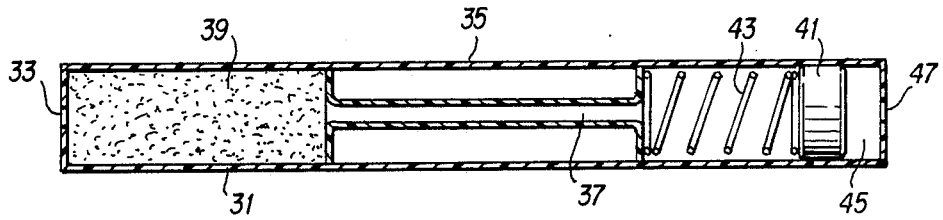
FIG. 2 illustrates a plastic cigarette having a piston and spring pumping device.

FIG. 2—The mouthpiece 31 contains tobacco 39 and has an opening 33 normally kept in the user's mouth.

The inner tube 37 passes co-axially through the plastic tube 35 and connects the end piece 45 acting as pumping device. The pumping device 45 consists of a piston or ball 41, and a spring 43 leaning on one end on the piston or ball 41, and on the other end on to the wall of the tube 35. Air flows in (or out) of the pumping device through the hole 47.

When the user starts operation by sucking in air through the mouthpiece 31 through the hole 33, it causes the piston or ball 41 to push in the spring 43 and move towards the user, thus causing air entry through the hole 47.

On release of suction by the user, the spring pushes the piston or ball 41 back, thus causing suction in the inner tube 37, which sucks in saliva from the user's mouth through the hole 33 and the tobacco 39. The cycle repeats itself when suction is again introduced by the user, this time however, he will suck back the saliva with the nicotine aroma.

Figure 3A:
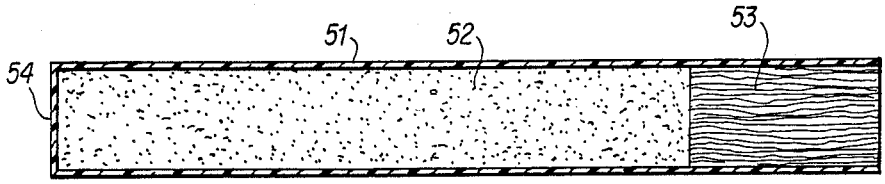
FIG. 3 illustrates a smokeless cigarette having a collapsable tube, and a filtered mouthpiece.
Figure 3B:
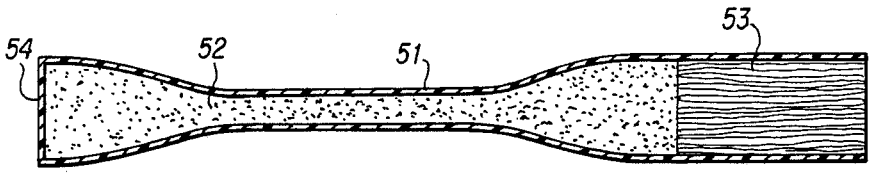

FIG. 3—illustrates a smokeless cigarette version having pumping means which comprise a flexible collapsable wall 51, with a tobacco insert 52, a mouthtip filter 53, and a sealed ending 54.

In position A the cigarette is illustrated in its natural shape, and in position B the cigarette is illustrated in its collapsed position when suction is applied at the mouth tip 53.

Several other designs of the pumping device can be demonstrated and the drawings hereby are given only as examples. One could also use this smokeless cigatrette for other types of aromas such as menthol or the like by changing the contents in the mouthpiece or tube and instead of tobacco introducing a microporous material saturated with any desired aroma. Thus the user will be able to suck in saliva saturated with any desired aroma.

In the prefered embodiment the mouthpiece should contain high aroma chewing tobacco, used in most chewing or sucking tobacco, which is most adaptable to saturate saliva and from which the aroma easily leaches out into the saliva.

What is claimed is:

1. A smokeless cigarette comprising:

a mouthpiece, a pumping means, and an inner tube disposed between said mouthpiece and said pumping means, said mouthpiece defining a chamber, a tobacco bed being disposed within said chamber, said inner tube connecting said mouthpiece chamber to said pumping means;

wherein, when suction is applied to the mouthpiece by a user, the pumping means create a vacuum in said tube, said vacuum drawing in saliva from the user's mouth when said suction is removed, said salive passing through said tobacco bed in said mouthpiece and being mixed with nicotine and aroma from the tobacco, wherein when said suction is repeated the saliva which is mixed with tobacco and aroma is transported back into the user's mouth, whereby said user has a continuous sensation of nicotine aroma which is drawn from said smokeless cigarette.

2. A cigarette as claimed in claim 1, wherein said pumping means is made of a pliable material, said material collapsing when suction is applied and returning to its original position when suction is released due to the flexibility of the material.

3. A cigarette as claimed in claim 1, wherein said inner tube is coaxially disposed within an outer tube, said pumping means being in the form of a cylindrical ending connected at one end to said inner tube and having an opening at its other end for permitting air entry, said pumping means comprising a piston positioned within said cylinder near the open end and a spring abutting against said piston at one end and against a wall of said outer tube at its other end, wherein upon said application of suction, said piston moves toward said inner tube, thereby pushing in said spring and allowing air flow through the open end of said cylinder, and upon release of said suction, said spring pushes said piston back towards said open end, thereby pushing out the air and creating a vacuum in said inner tube, wherein saliva is drawn from the user's mouth and mixed with the tobacco within the mouthpiece.

4. A cigarette as claimed in claim 3, wherein said piston is ball-shaped and has a diameter which is slightly smaller than an inner cylindrical wall of said cylindrical ending.

5. A cigarette as claimed in any one of claims 1–4, wherein the tobacco used in the mouthpiece is chewing or sucking tobacco having any aroma.

6. A cigarette as claimed in any one of claims 1–4, wherein said mouthpiece is filled with a micropore material saturated with a desired aroma.

7. A cigarette as in claim 6 wherein said aroma is menthol.

8. A smokeless cigarette comprising:

a tube having pumping means comprising walls made of a collapsable flexible material, said tube being attached at one end to a mouthpiece and being sealed at its other end by an end piece, said flexible tube having tobacco disposed therein;

wherein, when suction is applied by a user at said mouthpiece, said flexible tube's walls collapse radially inwards, and when suction is released, said tube returns to its original shape and a vacuum is formed in said tube, said vacuum drawing saliva from the user's mouth into said tube, wherein, when suction is repeated, the saliva within the tube picks up nicotine and aroma from said tobacco and returns to the user's mouth.

9. A cigarette as claimed in claim 8, wherein a filter tip is positioned in said mouthpiece for allowing the free flow of said salive and restricting the flow of tobacco particles from said tube to the user's mouth.

10. A cigarette as claimed in one of claims 8 or 9, wherein the tobacco used in the tube is chewing or sucking tobacco having any aroma.

11. A cigarette as claimed in one of claims 8 or 9, wherein said tube is filled with a micropore material saturated with a desired aroma.

* * * * *